US005958849A

United States Patent [19]

Hewson et al.

[11] Patent Number: 5,958,849

[45] Date of Patent: Sep. 28, 1999

[54] HIGH PERFORMANCE METAL WORKING OIL

[75] Inventors: William Donald Hewson, Sarnia; Gerald Keith Gerow, Brights Grove, both of Canada

[73] Assignee: Exxon Research and Engineering Co., Florham Park, N.J.

[21] Appl. No.: 08/778,530

[22] Filed: Jan. 3, 1997

[51] Int. Cl.[6] ..... C10M 141/10; C10M 141/08

[52] U.S. Cl. ..... 508/345; 252/78.1; 508/322; 508/343

[58] Field of Search ..... 508/322, 343, 508/486, 345; 252/78.1

[56] References Cited

U.S. PATENT DOCUMENTS

| | | | |
|---|---|---|---|
| 2,718,501 | 9/1955 | Harle | 508/563 |
| 2,879,281 | 3/1959 | Brokaw | 508/486 X |
| 3,265,620 | 8/1966 | Helman | 508/176 |
| 3,507,792 | 4/1970 | Zuraw | 508/280 |
| 3,537,999 | 11/1970 | Kennedy | 508/272 |
| 3,625,894 | 12/1971 | Koenig et al. | 508/280 |
| 3,723,315 | 3/1973 | Sullivan | 508/202 |
| 3,740,333 | 6/1973 | Hutchinson et al. | 508/330 |
| 3,791,803 | 2/1974 | Andress, Jr. et al. | 44/63 |
| 3,919,096 | 11/1975 | Olszewski | 508/282 |
| 4,102,796 | 7/1978 | Lowe | 508/322 |
| 4,149,982 | 4/1979 | Lee et al. | 508/343 |
| 4,166,795 | 9/1979 | Recchuite | 508/343 |
| 4,180,466 | 12/1979 | Newingham et al. | 508/343 |
| 4,315,889 | 2/1982 | McChesney et al. | 422/7 |
| 4,416,788 | 11/1983 | Apikos | 508/153 |
| 4,740,322 | 4/1988 | DiBiase et al. | 508/331 |
| 4,740,323 | 4/1988 | Suzuki et al. | 508/337 |
| 4,959,168 | 9/1990 | Schroeck | 508/343 X |
| 5,133,889 | 7/1992 | Born et al. | 508/322 |
| 5,308,654 | 5/1994 | Nagae et al. | 508/322 X |

FOREIGN PATENT DOCUMENTS

| | | | |
|---|---|---|---|
| 1046047 | 1/1979 | Canada | C10M 3/12 |
| 1228847 | 11/1987 | Canada | C10M 141/08 |
| 57-0858893 | 5/1982 | Japan | C10M 01/38 |
| 58-109597 | 6/1983 | Japan | C10M 03/20 |
| 60-141795 | 7/1985 | Japan | C10M 125/22 |
| 60-170698 | 9/1985 | Japan | C10M 145/14 |
| 2215894 | 8/1990 | Japan | C10M 101/02 |
| 2228393 | 9/1990 | Japan | C10M 111/02 |
| 3172394 | 7/1991 | Japan . | |
| 07126680 | 5/1995 | Japan | C10M 141/10 |
| 1266853 | 10/1986 | U.S.S.R. | C10M 30/08 |
| 1319246 | 6/1973 | United Kingdom | C07D 49/00 |
| 2071139 | 9/1981 | United Kingdom | C10M 1/38 |
| 1599714 | 10/1981 | United Kingdom | C10M 1/06 |
| 1599715 | 10/1981 | United Kingdom | C10M 1/06 |

OTHER PUBLICATIONS

"Inhibitory Activities of Triazole Compounds in Metalworking Fluids", Bennett et al, Journal of the American Society of Lubrication Engineering, Apr. 1980, pp. 215–218.

*Primary Examiner*—Richard D. Lovering
*Attorney, Agent, or Firm*—Joseph J. Allocca

[57] ABSTRACT

The present invention is a non-emulsifying, chlorine-free metal working or cutting oil which exhibits the same or superior performance as heretofore exhibited by chlorine containing fluids. The metal working oil contains cosulfurized olefins, polysulfurized hydrocarbon, phosphate esters, animal triglycerides, high molecular weight polyolefins in a mineral oil basestock. The oil may also contain metal deactivators, antioxidants and preservatives such as BHT, and mixtures of the above.

6 Claims, No Drawings

HIGH PERFORMANCE METAL WORKING OIL

BACKGROUND OF THE INVENTION

1. Field of the Invention

The present invention relates to metal working fluids or cutting oils which are non-emulsifying and chloride-free.

2. Description of the Related Art

Over the years, chlorinated paraffins were highly regarded for their outstanding performance in metal working fluids. However, in the recent years, concerns regarding their toxicity, and concomitant regulatory and disposal concerns have arisen which cloud their long term continued use. Further, potential users are no less susceptible than anyone else of the public impression that chlorinated materials in general are best avoided.

Beginning in about 1985, the toxicity of short chain (i.e., 13 or fewer carbons) chlorinated paraffins became an issue when it was found they caused concern in experimental animals. Information regarding chlorinated paraffins of greater carbon number is lacking, but public concern is sufficient reason to seek to reduce or eliminate chlorinated hydrocarbons from applications and formulations wherever possible. Short chain chlorinated paraffins are in the EPA's Toxic Release Inventory.

Disposal of chlorinated material is also complicated and expensive. The presence of 1000 ppm or more chlorine in oily waste requires that the waste be handled as an RCRA hazardous waste. Combustive disposal of chlorinated waste can create dioxins unless the incinerator operates at extremely high temperatures.

Substitution and replacement of chlorinated paraffins in metal working fluids which heretofore contained such chlorinated material would be a desirable accomplishment from the standpoint of public health, disposal and regulatory concerns, provided the chlorine-free cutting oils performed equally as compared to the chlorinated products they replaced.

DESCRIPTION OF THE INVENTION

The present invention is a non-emulsifiable, chlorine-free metal working oil or cutting fluid comprising a major amount of a base oil of lubricating viscosity and a minor amount of an additive package comprising a mixture of sulfurized olefins, polysulfurized hydrocarbons, phosphate esters, refined triglycerides and, optionally, additional materials selected from the group consisting of antimist additives, antioxidants, metal deactivators, dyes and mixtures thereof.

The basestocks employed in the metal working or cutting fluids of the present invention are oils of lubricating viscosity, i.e., oils having kinematic viscosity at 40° C. in the 5 to 250 cSt range, preferably 8 to 200 cSt range, most preferably 10 to 185 cSt.

The lubricating oil basestock can be derived from natural lubricating oils, synthetic lubricating oils, or mixtures thereof. Suitable lubricating oil basestocks include basestocks obtained by isomerization of synthetic wax and slack wax, as well as hydrocrackate basestocks produced by hydrocracking (rather than solvent extracting) the aromatic and polar components of the crude.

Natural lubricating oils include petroleum oils, mineral oils, and oils derived from coal or shale which are refined by typical procedures including fractionating distillation, solvent extraction, dewaxing and hydrofinishing.

Synthetic oils include hydrocarbon oils and halo-substituted hydrocarbon oils such as polymerized and interpolymerized olefins, alkylbenzenes, polyphenyls, alkylated diphenyl ethers, alkylated diphenyl ethers, alkylated diphenyl sulfides, as well as their derivatives, analogs, and homologs thereof, and the like. Synthetic lubricating oils also include alkylene oxide polymers, interpolymers, copolymers and derivatives thereof wherein the terminal hydroxyl groups have been modified by esterification, etherification, etc. Another suitable class of synthetic lubricating oils comprises the esters of dicarboxylic acids with a variety of alcohols. Esters useful as synthetic oils also include those made from $C_5$ to $C_{12}$ monocarboxylic acids and polyols and polyol ethers.

Silicon-based oils (such as the polyalkyl-, polyaryl-, polyalkoxy-, or polyaryloxy-siloxane oils and silicate oils) comprise another useful class of synthetic lubricating oils. Other synthetic lubricating oils include liquid esters of phosphorus-containing acids, polymeric tetrahydrofurans, polyalphaolefins, and the like.

The lubricating oil may be derived from unrefined, refined, rerefined oils, or mixtures thereof. Unrefined oils are obtained directly from a natural source or synthetic source (e.g., coal, shale, or tar and bitumen) without further purification or treatment. Examples of unrefined oils include a shale oil obtained directly from a retorting operation, a petroleum oil obtained directly from distillation, or an ester oil obtained directly from an esterification process, each of which is then used without further treatment. Refined oils are similar to the unrefined oils except that refined oils have been treated in one or more purification steps to improve one or more properties. Suitable purification techniques include distillation, hydrotreating, dewaxing, solvent extraction, acid or base extraction, filtration, and percolation, all of which are known to those skilled in the art. Rerefined oils are obtained by treating refined oils in processes similar to those used to obtain the refined oils. These rerefined oils are also known as reclaimed or reprocessed oils and often are additionally processed by techniques for removal of spent additives and oil breakdown products.

Lubricating oil basestocks derived from the hydroisomerization of wax may also be used, either alone or in combination with the aforesaid natural and/or synthetic basestocks. Such wax isomerate oil is produced by the hydroisomerization of natural or synthetic waxes or mixtures thereof over a hydroisomerization catalyst.

Natural waxes are typically the slack waxes recovered by the solvent dewaxing of mineral oils; synthetic waxes are typically the wax produced by the Fischer-Tropsch process.

The resulting isomerate product is typically subjected to solvent dewaxing and fractionation to recover various fractions of specific viscosity range. Wax isomerate is also characterized by possessing very high viscosity indices, generally having a VI of at least 130, preferably at least 135 and higher and, following dewaxing, a pour point of about −20° C. and lower.

The production of wax isomerate oil meeting the requirements of the present invention is disclosed and claimed in U.S. Pat. No. 5,059,299 and U.S. Pat. No. 5,158,671.

The preferred stocks are the natural stocks as the premium cost of stocks such as polyalphaolefms, esters, etc., is not justified for cutting oils.

The additive package comprises a mixture of materials comprising sulfirized olefins, said olefins comprising hydrocarbons, vegetable origin fatty acid alkyl esters and vegetable based triglycerides, polysulfurized hydrocarbons, phosphate esters, refined triglycerides, and, optionally, additional additives selected from the group consisting of anti-mist agents, metal deactivators, antioxidants, and mixtures thereof.

The sulfurized olefin comprises a mixture of sulfurized hydrocarbon, sulfurized vegetable origin fatty acid alkyl esters and sulfurized vegetable based triglycerides. Preferably, the sulfurized olefins are a cosulfurized product, produced by sulfurizing a mixture of triglycerides, alkyl esters of fatty acids, and olefins resulting in what is believed to be a network polymer where the sulfide linkages bond together all three molecular types. The degree of sulfurization ranges from 10 to 40% in sulfur, preferably 15 to 30% sulfur. The triglycerides can be from any source, animal or vegetable, preferably vegetable. The alkyl esters of vegetable origin fatty acids are the $C_1$–$C_{20}$ alcohol esters and mixtures thereof The olefin is any $C_3$ to $C_{15}$ olefin, preferably isobutylene. A preferred cosulfurized product is secured by co-sulfurizing vegetable triglycerides, methyl to pentyl-esters of vegetable fatty acids and $C_4$–$C_{12}$ olefin. The most preferred material is the cosulfurized product of canola triglycerides, methylesters of canola derived fatty acids and isobutylene. Appropriate materials are available commercially from Rhein Chemie under the tradename Additin.

This sulfurized olefin mixture component is used in the present composition in an amount in the range of 0.5 to 15 vol%, preferably 2 to 12 vol%.

Polysulfurized hydrocarbons used in the present formulations comprise the sulfurization product of at least one aliphatic or alicyclic olefinic compound containing about 3 to 30 carbons. Polysulfurized hydrocarbons suitable for use in the present invention are those of the formula:

$$R_1S_nR_2$$

wherein $R_1$ and $R_2$ are the same or different and are selected from $C_3$ to $C_{30}$ olefins, preferably $C_3$ to $C_{15}$ olefins and "n" averages between 2 and 6. Preferably, $R_1$ and $R_2$ are isobutylene and "n" averages between 2 and 6. When "n" is greater than 6, the molecule tends to decompose to give elemental sulfur while when "n" is less than 2 the reactivity is low. Materials of this type are available commercially from many suppliers such as The Lubrizol Corporation.

The polysulfurized hydrocarbons are present in the present formulation in an amount in the range of about 0.5 to 15 vol%, preferably, 1 to 5 vol%.

Phosphate esters used in the present invention are of the type OP $(OR)_3$ where R's are the same or different and selected from $C_1$ to $C_{10}$ alkyl, substituted aryl, preferably all R's are the same and are cresyl, isopropylphenyl, phenyl, xyenyl, t-butylphenyl, preferably isopropylphenyl. Appropriate examples of materials of this type are available commercially under the tradename Durad from FMC.

These phosphates are present in the formulation in an amount in the range of about 0.1 to 5 vol%.

The present formulation also contains refined triglycerides derived from animal or vegetable sources, preferably highly refined animal (pig, sheep, cattle) triglycerides, e.g., lard oil, used in an amount in the range of 0.5 to 10 vol%. Animal fats are preferred because of the relatively high saturation and therefore chemical inertness of the fatty acids associated with the triglycerides. Materials of this type are commercially available under the tradename Emersol from Emery Chemicals.

Optionally, oil soluble metal deactivators such as triazoles or thiodiazoles may also be present. If present at all, they are used in an amount in the range 0.01 to 0.5 vol%. Such materials include triazoles, aryl triazoles such as benzotriazole, tolyl triazole, derivatives of such triazoles such as $$R(C_6H_3)N_3CH_2R_{12}$$

where R and $R^1$ are the same or different and are H, $C_1$ to $C_{15}$ alkyl, preferably R and $R^1$ range from $C_6$ to $C_{10}$ alkyl; benzothiadiazoles such as $R(C_6H_3)N_2S$ can also be used wherein R is H or $C_1$ to $C_{10}$ alkyl. Suitable materials are available from Ciba Geigy under the tradenames Irgamet and Reomet or from Vanderbilt Chemical Corporation under the Vanlube tradename.

Preferably, the triazoles and derivatives of benzotriazoles are employed if metal deactivators are present in the formulation at all.

Antimisting agents may be optionally employed in an amount based on active ingredients in the range 0.05 to 5.0% by vol. Antimisting agents are typically oil soluble organic polymers ranging in molecular weight (viscosity average molecular weight) from about 0.3 to over 4 million. Typical polymers include those derived from monomers such as isobutylene, styrene, alkyl methacrylate, ethylene, propylene, n-butylene vinyl acetate, etc. Preferred materials are polymethylmethacrylate or poly(ethylene, propylene, butylene or isobutylene) in the molecular weight range 1 to 3 million. Most preferred is polyisobutylene of molecular weight between 1.6 to 3 million, more preferably about 2.1 to 2.35 million. Such polymers are typically used as a solution of 4 to 6 wt % polymer in mineral oil diluent. Methacrylates are available from Rohm GmBH or Rohm and Haas while polyolefin materials can be secured from Exxon Chemical Company.

Antioxidants are also useful in certain applications of the lubricating oil of the present invention, such as when the oil serves the dual purpose of cutting fluid and machine lube oil.

Generally, any antioxidant of the aminic or phenolic type or mixtures thereof can be employed, and, if present at all, is used in an amount in the range 0.01 to 1.0 wt %. Phenolic antioxidants are preferred because of their lower cost. Phenolic antioxidants include butylated hydroxy toluene (BHT), bis-2,6-di-t-butylphenol derivatives, sulfur containing hindered phenols, sulfur containing hindered bis-phenol. BHT is the preferred antioxidant.

EXAMPLES

A series of formulations corresponding to the present invention was prepared and subject to evaluation in metal working and metal cutting applications under a variety of conditions on different metals using different cutting and/or working tools. A number of the formulations were compared in terms of performance against different commercially available cutting and/or working fluids.

TABLE 1

| Component | A vol % | B vol % | C vol % | D vol % | E vol % | F vol % |
|---|---|---|---|---|---|---|
| 100N20 | | 92.62 | | 16.80 | 87.04 | 85.07 |
| MCT 10 Base | | | 92.04 | | | |
| 3040 Process Oil | 93.05 | | | 70.17 | | |
| Co sulfurized olefin mixture | 3.05 | 3.47 | 3.53 | | | |
| Co sulfurized olefin mixture | | | | 6.82 | 6.78 | 10.66 |
| Low odor polysulfurized hydrocarbon | | | | 0.86 | 0.85 | 0.85 |
| Lard oil | 2.85 | 2.36 | 2.88 | 3.85 | 3.83 | 1.92 |
| Isopropyl phenyl phosphate | | 0.50 | 0.50 | 0.50 | 0.50 | 0.50 |
| Triazole derivative (copper deactivator) | 0.05 | 0.05 | 0.05 | | | |
| Polyisobutylene | 1.00 | 1.00 | 1.00 | 1.00 | 1.00 | 1.00 |
| BHT | | | 0.30 | | | |
| Total | 100.00 | 100.00 | 100.00 | 100.00 | 100.00 | 100.00 |
| Appearance | Bright & Clear | Bright & Clear | Bright & Clear | Bright & Clear | Bright & Clear | Bright & Clear |
| Color | Yellow | Yellow | Yellow | Yellow | Yellow | Yellow |
| Color D1500 | <1 | <1 | <1 | <1.5 | <1.5 | <1.5 |
| KV 40 C cSt | 10.9 | 25.0 | 37.0 | 14.0 | 27.0 | 31.0 |
| Cu Corr D130 | 1b | 1b | 1a | 4c | 4c | 4c |
| Flash COC C | 160 | 202 | 206 | 160 | 190 | 192 |
| Density g/cm$^3$ | 0.8721 | 0.8683 | 0.8791 | 0.8822 | 0.8770 | 0.8831 |
| Sulfur total wt % | 0.72 | 0.72 | 0.76 | 2.5 | 2.5 | 3.7 |
| Sulfur active wt % | 0.1 | 0.1 | 0.1 | 1.6 | 1.6 | 2.2 |
| Phosphorus wt % | nil | 0.061 | 0.058 | 0.052 | 0.052 | 0.071 |
| Tapping Torque % Eff. | | | | | | |
| AISI 1215 | 185 | 188 | 193 | 194 | 186 | 187 |
| AISI 1018 | 130 | 133 | 128 | 139 | 141 | 147 |
| AISI 4140 | 120 | 117 | 120 | 122 | 121 | 124 |
| Falex EP D3233 lb-f | 1070 | 950 | 1150 | 1880 | 1960 | 1880 |

(1)Sulfurized fatty esters and isobutylene; 15% total sulfur, 4% active sulfur.
(2)Sulfurized fatty esters and isobutylene; 26% total sulfur, 15% active sulfur.
(3)Low odor sulfurized olefin; 37% total sulfur, 37% active sulfur.

EXAMPLE 1

Formulation C was compared against a commercial machine oil chlorinated at 1.3%. The oils were employed in a New Britain Model 52 screw machine used to fabricate steel fittings. The steel being cut was AISI 12L14 which is a resulfurized and rephosphorized steel with added metallic lead which makes it highly machinable. The cutting tools were primarily M 2 tool steel. The machine oil lubricates a variety of components in the machine including steel gears on bronze bushings, bronze gears, inverted tooth and roller chains, various rolling element bearings, clutches, and slideways. Oil is circulated by a gear pump and the oil is strained and filtered.

When using the chlorinated oil as lubricant, machine amperage varied from 10 to 12 A. The temperature of the oil in the sump was measured when the machine was stopped and found to be 33° C. Ambient temperature was 25° C. The machine was refilled with Test Formulation C and similarly used to cut the same metal. It drew 10 to 12 A and, upon stopping, the oil temperature was found to be 33° C. The Test Formulation was, therefore, found to behave substantially, if not identically, as the chlorinated commercial lubricant. There was no detectable difference in the performance of the oils.

EXAMPLE 2

Test Formulation C was compared against a commercial lubricant containing 0.3 wt % chlorine (Commercial Oil A), a commercial lubricant containing 1.3 wt % chlorine (Commercial Oil B), and a commercial oil containing no chlorine (Commercial Oil C), in a Brown & Sharpe screw machine employing a variety of tool steel cutting tools machining AISI 12L14 screw machine stock. Performance criteria were tool life, surface finish, machine tool vibration, and smoke minimization. The Brown & Sharpe screw machine employs bronze gibs.

Machine tool vibration is unacceptable during metal removal operations. Vibration destroys the machine tool gibs and bearings, shortens tool life, degrades the precision of the cut, degrades the workpiece surface finish, and causes excess heat and smoke. Vibration or chatter is usually a self-excited phenomenon where the cutting tool cyclically digs in and releases from the rotating workpiece. Vibration is symptomatic of a cut that is too deep and/or too wide where there is too little stiffness in the workpiece and/or machine tool.

Vibration is the result of an inappropriate machining set up and does not typically reflect cutting oil performance issues. However, Commercial Oil C did allow more vibration than Commercial Oil A.

The use of Commercial Oil B resulted in considerably less machine tool vibration as compared to Commercial Oil A or Commercial Oil C. Workpiece surface finish was improved, vibration was audibly less, there was less smoke, and form tool life was extended from a one- to a three-day resharpening period.

With Commercial Oil B, the temperature of the oil just down-stream of the workpiece was 39° C. (ambient 15° C.). With Commercial Oil A, the oil just downstream was at a temperature of 42° C. (ambient 18° C.). Both chlorinated oils behaved substantially similarly.

Commercial Oil B was replaced with Test Formulation C. Comparison showed that both oils equilibrated near the same temperature, about 24° C. above ambient. Initially, with Test Formulation C, there was more machine vibration than with Commercial Oil C. This was detectable audibly and on the surface finish of the machined part. As Test Formulation C warmed up and a greater flow was delivered to the cutting region, vibration was not much different than for Commercial Oil B (1.3% chlorine). Tool life comparison showed Test Formulation C performed as well as Commercial Oil B with a three-day resharpening period.

Test Formulation C performed equivalently to Commercial Oil B (1.3% chlorine) and outperformed Commercial Oil C (0% chorine) while it itself has zero chlorine content. Machine tool vibrating responded to the presence of the co-sulfurized fat/ester/olefin present in Test Formulation C. Such co-sulfurized material is used as a stick-slip friction modifier for way lubricants and is here found useful for vibration reduction.

EXAMPLE 3

Test Formulation B was evaluated in a Davenport screw machine as both machine oil and cutting oil in the fabrication of brass pieces, and compared favorably with Commercial Oil B (1.3 wt % chlorine and sulfurized sperm oil replacement). There was some minor foaming with Formulation B, but this was due to the rather high "waterfall" of cutting oil flowing from the machine bed into the cutting oil tank. A higher oil level in the reservoir would reduce the "waterfall" height and reduce foaming. Electron microscope comparison of the work pieces produced revealed no differences in surface finish, brightness or flashing.

The brass stock which was machined is known as 360 alloy using the U.S. copper and brass designation. The Unified Numbering System (UNS) designates the alloy as C36000. Tool steel tools were employed to perform drilling, threading, turning, and parting operations.

EXAMPLE 4

Test Formulation F was compared against a commercial oil containing 1.9 wt % chlorine (Commercial Oil D) in terms of cutting tool life in an operation employing hardened tool steel cutting tool to machine annealed tool steel workpieces. The chemically refractory nature of tool steels make them much less susceptible to chemical sulfurization or chlorination by cutting oil additives. The fracture mechanics of the workpiece substrate remain unchanged in response to additive variation. In highly refractory machinery operations, a cutting oil, therefor, functions mainly as a coolant and lubricant.

The test employed an OOZT-ALATNI MASINI machine tool which holds about 100 liters of cutting oil. The cutting tool was a form relief cutter made with hardened T15 tool steel and the workpiece substrate was also a tool steel M4, but in the soft annealed condition. The product being fabricated was a side and face milling wheel cutter. The cutter has a diameter of 135 mm, width 15.4 mm, and a 40 mm bore.

The primary criterion of cutting oil performance was the life of the form relief cutter. The life is measured by the number of parts made before the need to resharpen. A series of eight form relief cutters were used to fabricate the milling wheel cutters with chlorinated Commercial Oil D followed by Test Formulation F. The resharpening period for the series of form relief cutters was the same for the two cutting oils. Thirty sharpenings were required per bar of substrate stock with both oils. The performance of chlorinated Commercial Oil D was the same as for chlorine-free Test Formulation F.

EXAMPLE 5

Test Formulation E was evaluated against Commercial Oil D in an OOZT-ALATNI MASINI machine tool using hardened T 15 tool steel cutters to machine annealed M4 tool steel workpieces. Both Test Formulation E (zero chlorine) and Commercial Oil D (1.9 wt % chlorine) were found to perform identically.

EXAMPLE 6

Test Formulation F and Test Formulation B were evaluated against two commercial oils in a Landis lathe.

Test Formulation F was compared against Commercial Oil F (1.7 wt % chlorine) and was found to perform equivalently with respect to tool life, machine noise, temperature rise in the workpiece, and surface finish of the workpiece. The operation involved cutting Grade 400 steel to an appropriate diameter for subsequent threading. The lathe employed a tool steel cutter and tool steel threading dies to perform this operation.

Test Formulation B was compared against Commercial Oil G (chlorine-free, 1 wt % sulfur and 29 cSt at 40° C.) in a Landis lathe used to roll threads on a wide variety of bar stock. The thread rollers are tool steel. This operation is a metal deformation or forming process rather than a cutting process. The stock which is employed is typically AISI 1541 and AISI 1540 (high manganese, 1.35 to 1.65 wt %, carbon steel). Because of the design of the machine, a low viscosity oil is required to permit lubricant to travel down small diameter oilways to reach the bushings.

Test Formulation B and Commercial Oil G were found to perform equivalently in this operation during the first two hours of operation but the unit was shut down after about four hours due to overheating. This was surprising because operation is slow due to manual feeding of the work pieces. Any temperature rise sufficient to warrant an automatic thermal shut down should have been first detected by the unit operator during hand feeding of the work piece. It is suspected that a broken forming tool gave a high torque which resulted in an unexpected, uncontrolled temperature rise unassociated with the lubricant used.

What is claimed is:

1. A chlorine free metal working fluid comprising a major amount of a base oil of lubricating viscosity and a minor amount of additives comprising a mixture of sulfurized olefins, polysulfurized hydrocarbons, phosphate esters, and refined triglycerides, wherein the polysulfurized hydrocarbons are of the formula $$R_1S_nR_2$$

wherein $R_1$ and $R_2$ are the same or different $C_3$–$C_{30}$ olefin, and n averages between 2 and 6.

2. The chlorine free metal working fluid of claim 1 wherein the additives contain additional components selected from the group consisting of antimist additives, antioxidants, metal deactivators, dyes and mixtures thereof.

3. The chlorine free metal working fluid of claim 1 or 2 wherein the sulfurized olefins comprise a mixture of sulfurized hydrocarbons, sulfurized vegetable origin fatty acid alkyl esters and sulfurized vegetable based triglycerides.

4. The chlorine free metal working fluid of claim 3 wherein the sulfurized olefins comprise a cosulfurized product produced by sulfurizing a mixture of triglycerides, alkyl esters of fatty acids and olefins.

5. The chlorine free metal working fluid of claim 1 or 2 wherein the polysulfurized hydrocarbons comprises the sulfurization product of at least one aliphatic or alicyclic olefinic compound containing 3 to 30 carbons.

6. A method for lubricating metal working machines and work pieces comprising using a chlorine free lubricant comprising a major amount of a base oil of lubricating viscosity and a minor amount of additives comprising a mixture of sulfurized olefins, polysulfurized hydrocarbons, phosphate esters, and refined triglycerides, wherein the polysulfurized hydrocarbons are of the formula $$R_1S_nR2$$

wherein $R_1$ and $R_2$ are the same or different $C_3$–$C_{30}$ olefin, and n averages between 2 and 6.

* * * * *